US006132060A

United States Patent [19]

Gallo

[11] Patent Number: 6,132,060

[45] Date of Patent: Oct. 17, 2000

[54] ILLUMINATING PUSH PIN

[76] Inventor: Anthony Richard Gallo, 8711 Granite Gorge Dr., Spring, Tex. 77379

[21] Appl. No.: 09/265,242

[22] Filed: Mar. 9, 1999

[51] Int. Cl.[7] ..... F21L 4/00

[52] U.S. Cl. ..... 362/190; 362/253; 362/34; 362/800; 40/452

[58] Field of Search ..... 362/103, 190, 362/253, 800, 812, 394, 34; 40/451, 452; 434/407

[56] References Cited

U.S. PATENT DOCUMENTS 3,873,885 3/1975 Elfve ..... 315/312
4,523,259 6/1985 Dorsett ..... 362/120
4,888,232 12/1989 Sallb ..... 428/215
5,010,463 4/1991 Ross ..... 362/253

*Primary Examiner*—Sandra O'Shea
*Assistant Examiner*—John Anthony Ward
*Attorney, Agent, or Firm*—Steven S. Newson

[57] ABSTRACT

A lighted push pin is provided that is a relatively low cost device which will perform all of the traditional functions of push pins while providing a superior capability to draw attention to specific items or highlight specific information through the use of illumination. Illumination is provided by an on-board battery that powers a light generating device such as a light bulb or light emitting diode. Another embodiment of the invention utilizes a chemical light source. Thus, the invention has eliminated any need for electrified boards or external sources of power.

8 Claims, 6 Drawing Sheets

ILLUMINATING PUSH PIN

CROSS REFERENCES TO RELATED APPLICATIONS

Not Applicable.

BACKGROUND

1. Field of Invention

This invention relates to push pins, specifically an improved illuminating push pin.

2. Description of Prior Art

Push pins have traditionally been used to affix one item to another, such as posting a note on a bulletin board. A second traditional use of push pins has been to draw attention to an item or a specific piece of information. For example, marking a specific place on a map or drawing attention to a specific note posted on a bulletin board full of notes. In order to accomplish this second use, push pins have been produced in various sizes, shapes and colors. Unfortunately, this approach has limited success in highlighting specific items. In order to increase the effectiveness of push pins to highlight specific items, methods of illuminating push pins have been developed. The majority of these methods consist of utilizing an electrified bulletin board to provide power to an illuminable push pin. The electrified bulletin boards consist of conductive sheets sandwiched by insulating layers. The push pin is equipped with electrical contacts that are inserted into the electrified bulletin board. These electrical contacts perform the function of the pin part of a traditional push pin. When the electrical contacts are inserted into the electrified bulletin board each electrical contact pierces one of the conductive sheets. This completes the electrical circuit and a bulb in the push pin lights. Examples of these types of systems include: U.S. Pat. No. 3,873,885 to Goran Elfver Elfverson Mar. 25, 1975; U.S. Pat. No. 4,888,232 to Michael E. R. Sallberg Dec. 12, 1989; and U.S. Pat. No. 5,010,463 to David L. Ross Apr. 23, 1991. Unfortunately, this type of system has some serious drawbacks. For example, this system requires that an electrified bulletin board be available at every location where a user may want to post a note. For example, if a person wanted to post a notice on the bulletin board at work or at a grocery store and an electrified bulletin board was not available, they would not be able to use an illuminable push pin to highlight their information. Another example is a situation where it was desirable to use an illuminable push pin to highlight an area on a map or a chart. The map or chart would first have to be mounted on an electrified bulletin board. The present invention overcomes this drawback by providing a self contained power supply. Therefore, it can be used anywhere a traditional push pin could be used. A second drawback to the systems that use an electrified bulletin board is the fact that the electrified bulletin boards use electrically conductive sheets that are built into the electrified bulletin boards. Over time and after numerous insertions and removals of the push pins, these electrically conductive sheets will wear out. The present invention overcomes this drawback because electrically conductive sheets are not required. In fact, a bulletin board is not required. A third drawback to the systems that use an electrified bulletin board is the fact that the electrified bulletin boards are more expensive due to the fact that a user must purchase the electrified board as well as the push pins. The present invention should be less expensive because the user only has to purchase the push pins. A fourth drawback to the systems that use an electrified bulletin board is the fact that the electrified bulletin boards require more space. The present invention does not require a board at all. Therefore, the present invention can be used where space is limited.

A second approach to providing a lighted system to affix two items together is the Bolt-Light Bulb Combination of U.S. Pat. No. 4,523,259 to Danny R. Dorsett, Gerald D. Smith Jun. 11, 1985. This device is a bolt with a light bulb contained therein. Power is provided to the bulb via electrical wires that pass through the bolt shank and to an external power supply. A drawback of this device is that it requires a matching female device into which the bolt can be threaded or a matching nut that can be threaded onto the bolt to affix it in place. This limits the number of places where the device can be used. The present invention is much more flexible and easier to use in that it can be used anywhere there is a surface that the pin can be inserted into. Another drawback of the Bolt-light Bulb Combination is that it requires an external power source whereas the present invention carries its own power supply.

OBJECTS AND ADVANTAGES

Accordingly, several objects and advantages of the invention are to provide a relatively low cost device which will perform all of the traditional functions of push pins while providing a superior capability to draw attention to specific items or highlight specific information through the use of illumination. The invention will accomplish this while providing the versatility to be used anywhere a traditional push pin may be used.

Still further objects and advantages will become apparent from a consideration of the ensuing description and accompanying drawings.

REFERENCE NUMERALS

18 cavity

19 passage

Figure 1:
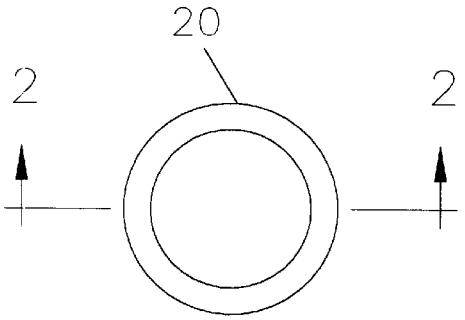
FIG. 1 is a top view of the preferred embodiment of the invention.

20 body
21 pin sharp end
22 pin
23 pin blunt end
24 battery
26 first battery terminal
28 second battery terminal
30 light generating device
32 first light generating device terminal
34 second light generating device terminal
36 electrical conductor
37 opening
38 pin stop
39 first socket terminal
40 socket
41 second socket terminal
42 fixed pin
44 switch
46 first switch conductor
47 second switch conductor
48 third switch conductor
50 fourth switch conductor
52 first plug conductor
54 second plug conductor
56 first chemical reservoir
58 second chemical reservoir
60 breakable barrier

SUMMARY

The present invention comprises a push pin body containing an independent light source (either electrical such as a battery or chemical).

Preferred Embodiment—Description

Figure 2:
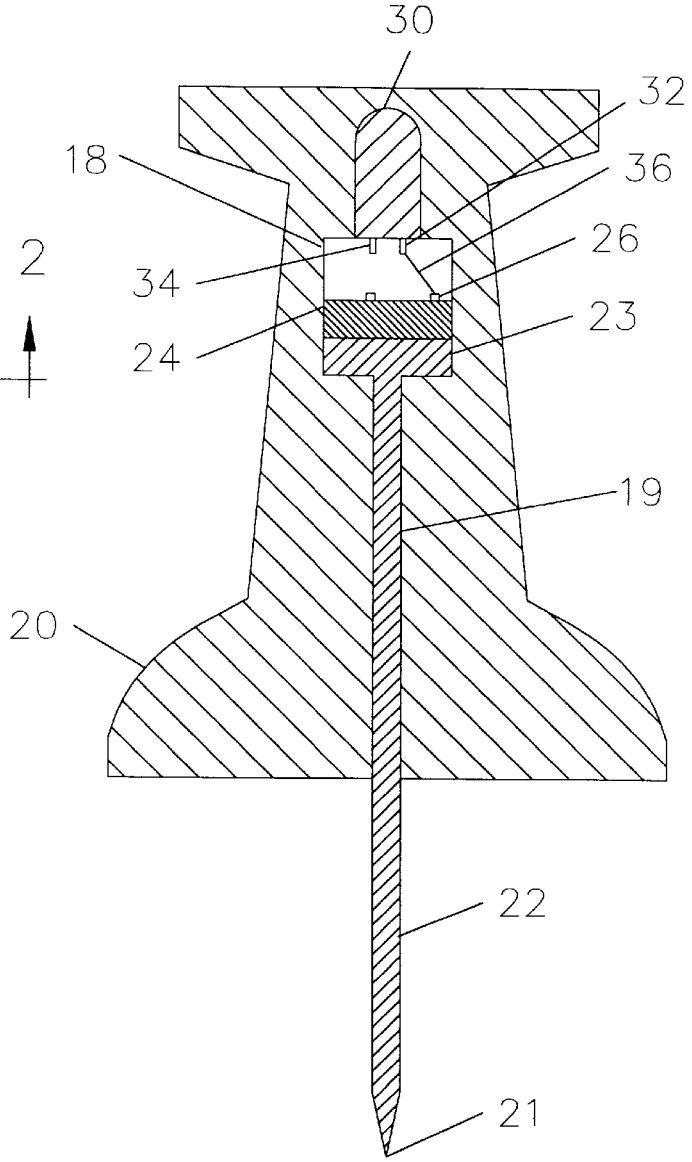
FIG. 2 is a front sectional view taken along the line 2—2 of FIG. 1.

FIG. 1 is a top view of the preferred embodiment of the invention and shows a body 20. The body 20 may be made of almost any material that will allow light to pass through it and the shape is not critical. As can be seen in FIG. 2, body 20 defines a cavity 18 and a passage 19. Pin 22, having a pin sharp end 21 and a pin blunt end 23, passes through passage 19 with the pin blunt end 23 located inside cavity 18 and the pin sharp end 21 located outside of body 20. Pin blunt end 23 is of a shape and size such that it will not pass through passage 19. Battery 24, having a first battery terminal 26 and a second battery terminal 28, rests on top of pin blunt end 23. A light generating device 30 such as a light bulb or light emitting diode, having a first light generating device terminal 32 and a second light generating device terminal 34, is mounted in body 20 above cavity 18. The light generating device 30 may be of a type that generates light of any desired color and may also be of a type that blinks. The first battery terminal 26 is electrically connected to the first light generating device terminal 32 by an electrical conductor 36. The second battery terminal 28 is located such that it is aligned with the second light generating device terminal 34.

Preferred Embodiment—Operation

Operation of the preferred embodiment is simple and straight forward. The user simply grasps body 20 and inserts pin sharp end 21 into any surface at the desired location. As the pin sharp end 21 contacts the surface the pin 22 is pushed through passage 19 and the pin blunt end 23 is forced farther into cavity 18. As pin blunt end 23 is pushed into cavity 18 it forces battery 24 towards light generating device 30 until the second battery terminal 28 contacts the second light generating device terminal 34. When the second battery terminal 28 contacts the second light generating device terminal 34 an electrical circuit, which also includes the first battery terminal 26 which is electrically connected by electrical conductor 36 to the first light generating device terminal 32, is closed. When the electrical circuit is closed the light generating device 30 receives power from battery 24 and lights. Thus, the user is provided with a functional push pin with the added advantage of attracting viewers attention with it's light.

OTHER EMBODIMENTS

Preferred Embodiment with Pin Stop—Description

Figure 3:
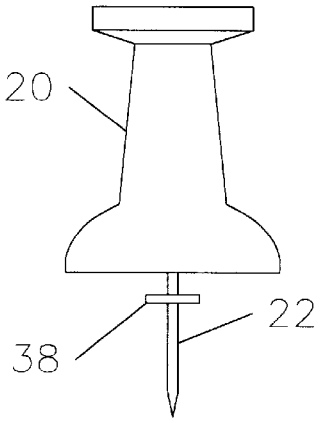
FIG. 3 is a front view of the preferred embodiment with the addition of a pin stop.

The preferred embodiment may be enhanced as shown in FIG. 3. As can be seen in FIG. 3, the preferred embodiment is altered by including a pin stop 38 affixed to pin 22 outside of body 20.

Preferred Embodiment with Pin Stop—Operation

The preferred embodiment with pin stop operates exactly as the preferred embodiment with one difference. As the pin sharp end 21 is inserted into the desired surface, the pin stop 38 makes contact with the surface and insures that pin 22 is forced through passage 19 causing light generating device 30 to light. This will also allow the device to be manufactured with a tight friction fit between the passage 19 and the pin 22. This tighter fit will help hold pin 22 in position and thus maintain good contact between second battery terminal 28 and second light generating device terminal 34 which will keep light generating device 30 lit.

Preferred Embodiment with Removable Light Generating Device—Description

Figure 4:
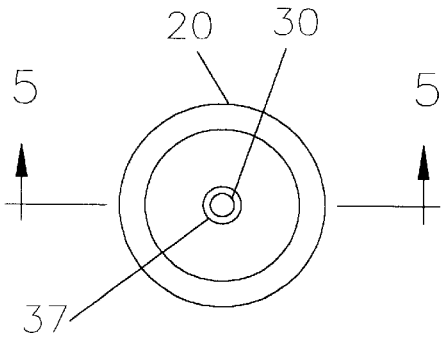
FIG. 4 is a top view of the preferred embodiment of the invention with removable light generating device.
Figure 5:
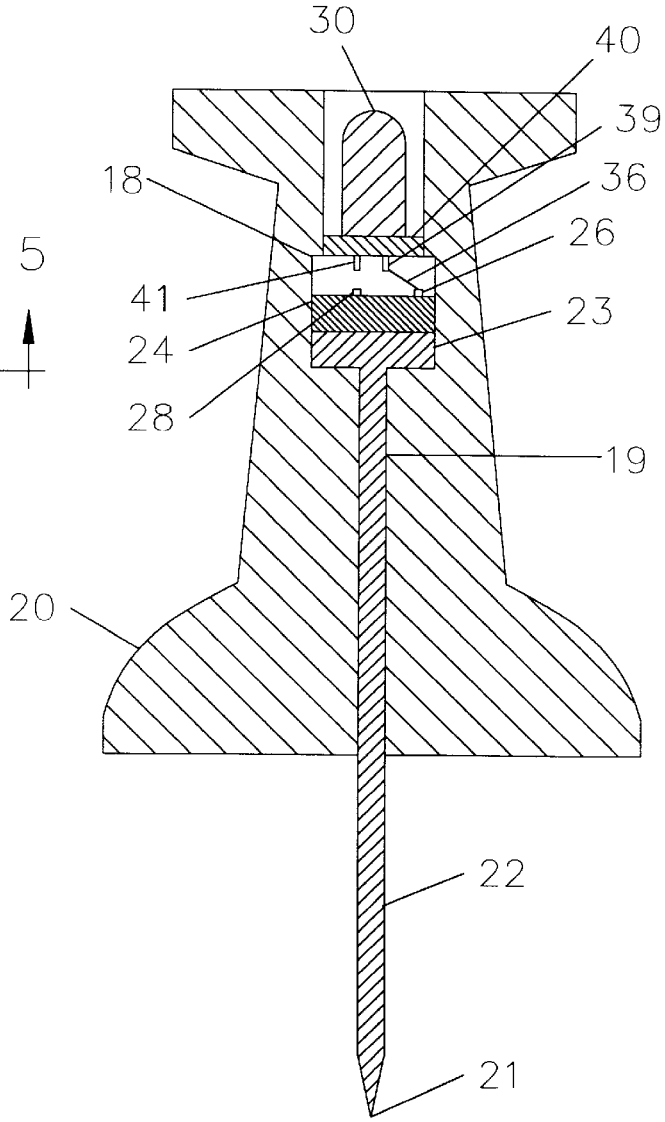
FIG. 5 is a front sectional view taken along the line 5—5 of FIG. 4.

FIG. 4 is a top view of the preferred embodiment with removable light generating device and shows a body 20. The body 20 may be made of almost any material that will allow light to pass through it and the shape is not critical. As can be seen in FIG. 5, body 20 defines a cavity 18 and a passage 19 and also an opening 37. Pin 22, having a pin sharp end 21 and a pin blunt end 23, passes through passage 19 with the pin blunt end 23 located inside cavity 18 and the pin sharp end 21 located outside of the body 20. Pin blunt end 23 is of a shape and size such that it will not pass through passage 19. A battery 24, having a first battery terminal 26 and a second battery terminal 28, rests on top of pin blunt end 23. A socket 40, having a first socket terminal 39 and a second socket terminal 41, is mounted in body 20 above cavity 18. A light generating device 30 such as a light bulb or light emitting diode is removably electrically plugged into socket 40. The light generating device 30 may be of a type that generates light of any desired color and may also be of a type that blinks. The first battery terminal 26 is electrically connected to the first socket terminal 39 by an electrical conductor 36. The second battery terminal 28 is located such that it is aligned with the second socket terminal 41.

Preferred Embodiment with Removable Light Generating Device—Operation

The preferred embodiment with removable light generating device operates in the same manner as the preferred embodiment with one addition. The light generating device 30 can be installed, removed and replaced through opening 37. This is accomplished by plugging the light generating device 30 into or unplugging it from socket 40 through opening 37.

Figure 6:
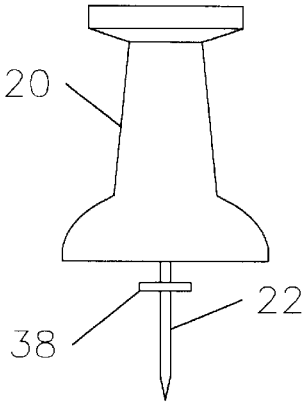
FIG. 6 is a front view of the preferred embodiment with removable light generating device and a pin stop.

Preferred Embodiment with Removable Light Generating Device and Pin Stop—Description The preferred embodiment with a removable light generating device may be enhanced as shown in FIG. 6. As can be seen in FIG. 6, the preferred embodiment with a removable light generating device is enhanced by including a pin stop 38 affixed to pin 22 outside of body 20.

Preferred Embodiment With Removable Light Generating Device and Pin Stop—Operation The preferred embodiment with removable light generating device and pin stop operates exactly as the preferred embodiment with a removable light generating device with one difference. As the pin sharp end 21 is inserted into the desired surface, the pin stop 38 makes contact with the surface and insures that pin 22 is forced through passage 19 causing light generating device 30 to light. This will also allow the device to be manufactured with a tight friction fit between the passage 19 and the pin 22. This tighter fit will help hold pin 22 in position and thus maintain good contact between second battery terminal 28 and second socket terminal 41 which will keep light generating device 30 lit.

Embodiment With Switch—Description

Figure 7:
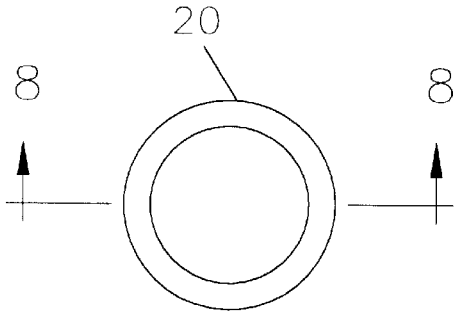
FIG. 7 is a top view of the embodiment with switch.
Figure 8:
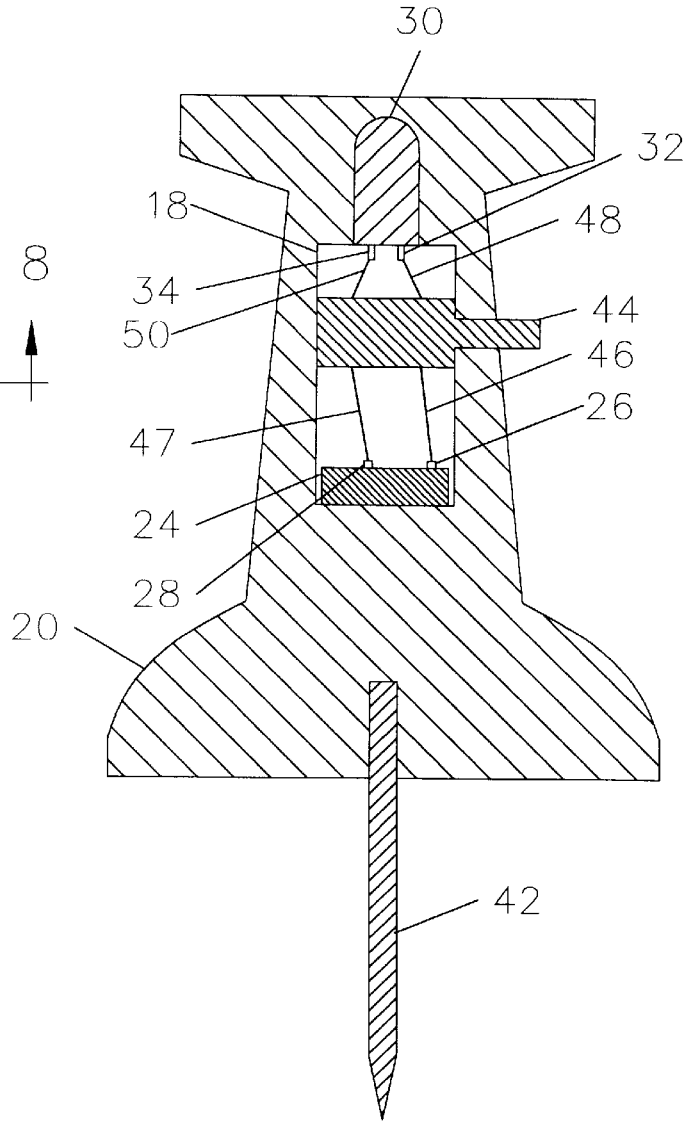
FIG. 8 is a front sectional view taken along the line 8—8 of FIG. 7.

FIG. 7 is a top view of the embodiment with switch and shows a body 20. The body 20 may be made of almost any material that will allow light to pass through it and the shape is not critical. As can be seen in FIG. 8, body 20 defines a cavity 18. A battery 24, having a first battery terminal 26 and a second battery terminal 28, is mounted inside cavity 18. A switch 44 affixed to body 20. The first battery terminal 26 is electrically connected to the switch 44 by a first switch conductor 46. The second battery terminal 28 is electrically connected to switch 44 by a second switch conductor 47. A light generating device 30 such as a light bulb or light emitting diode, having a first light generating device terminal and a second light generating device terminal 34, is mounted in body 20. The light generating device 30 may be of a type that generates light of any desired color and may also be of a type that blinks. The first light generating device terminal 32 is electrically connected to switch 44 by a third switch conductor 48. The second light generating device terminal 34 is electrically connected to switch 44 by a fourth switch conductor 50. A fixed pin 42 is mounted in body 20 and extends out of body 20.

Embodiment With Switch—Operation

The operation of the embodiment with switch is very simple. The user inserts fixed pin 42 into any surface at the desired location. The user then activates switch 44 which allows power to be transmitted to light generating device 30. The light generating device 30 then lights. This embodiment has the advantage that the device can easily be turned on and off.

Embodiment with Switch and Removable Light Generating Device—Description

Figure 9:
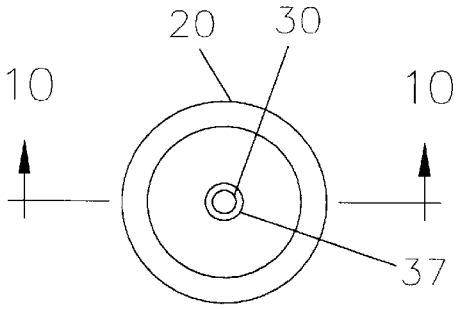
FIG. 9 is a top view of the embodiment with switch with removable light generating device.
Figure 10:
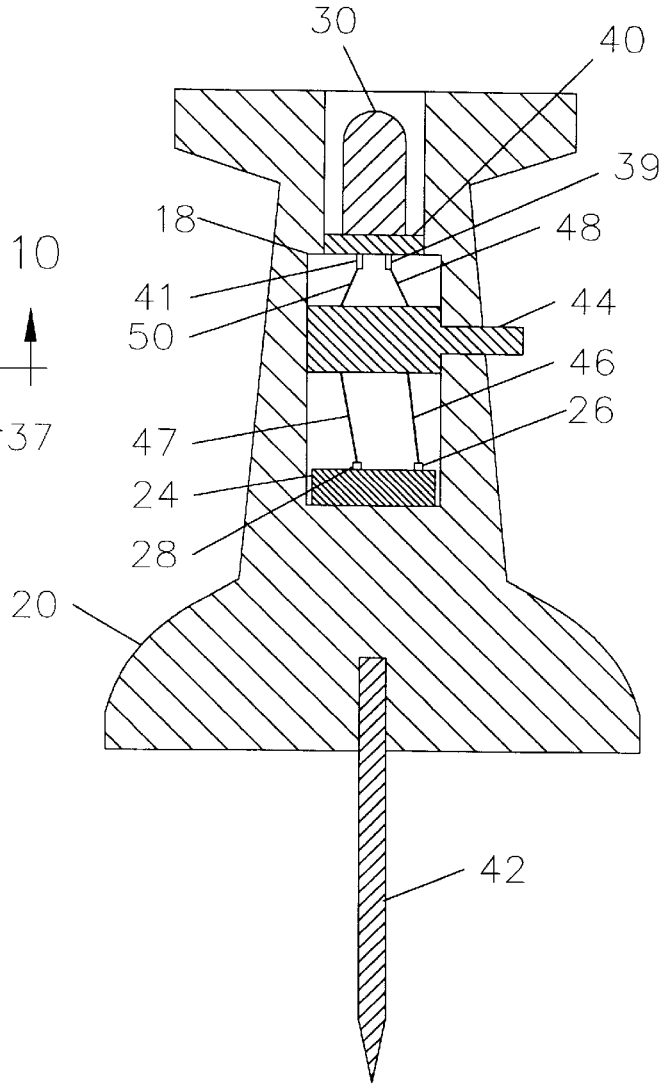
FIG. 10 is a front sectional view taken along the line 10—10 of FIG. 9.

FIG. 9 is a top view of the embodiment with switch and removable light generating device and shows a body 20. The body 20 may be made of almost any material that will allow light to pass through it and the shape is not critical. As can be seen in FIG. 10, body 20 defines a cavity 18 and an opening 37. A battery 24, having a first battery terminal 26 and a second battery terminal 28, is mounted inside cavity 18. A switch 44 affixed to body 20. The first battery terminal 26 is electrically connected to the switch 44 by a first switch conductor 46. The second battery terminal 28 is electrically connected to switch 44 by a second switch conductor 47. A socket 40, having a first socket terminal 39 and a second socket terminal 41, is mounted in body 20. A light generating device 30 such as a light bulb or light emitting diode is removably electrically plugged into socket 40. The light generating device 30 may be of a type that generates light of any desired color and may also be of a type that blinks. The first socket terminal 39 is electrically connected to switch 44 by a third switch conductor 48. The second socket terminal 41 is electrically connected to switch 44 by a fourth switch conductor 50. A fixed pin 42 is mounted in body 20 and extends out of body 20.

Embodiment with Switch and Removable Light Generating Device—Operation

The operation of the embodiment with switch and removable light generating device is the same as the operation of the embodiment with switch with one addition. The light generating device 30 can be installed, removed and replaced through opening 37. This is accomplished by plugging the light generating device 30 into or unplugging it from socket 40 through opening 37.

Embodiment with Removable Light Generating Device—Description

Figure 11:
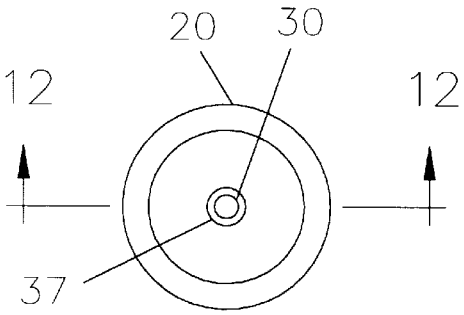
FIG. 11 is a top view of the embodiment with removable light generating device.
Figure 12:
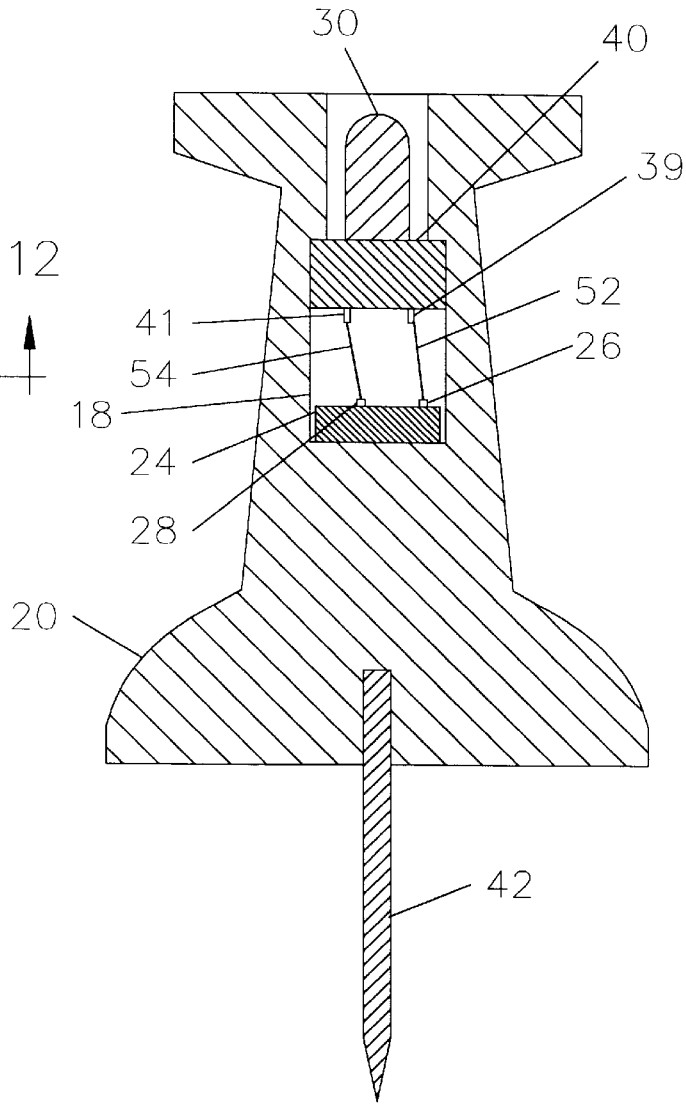
FIG. 12 is a front sectional view taken along the line 12—12 of FIG. 11.

FIG. 11 is a top view of the embodiment with removable light generating device and shows a body 20. The body 20 may be made of almost any material that will allow light to pass through it and the shape is not critical. As can be seen in FIG. 12, body 20 defines a cavity 18 and an opening 37. A battery 24, having a first battery terminal 26 and a second battery terminal 28, is mounted inside cavity 18. A socket 40, having a first socket terminal 39 and a second socket terminal 41, is also mounted in cavity 18. A light generating device 30 such as a light bulb or light emitting diode is removably electrically plugged into socket 40. The light generating device 30 may be of a type that generates light of any desired color and may also be of a type that blinks. The first socket terminal 39 is electrically connected to the first battery terminal 26 by a first plug conductor 52. The second socket terminal 41 is electrically connected to the second battery terminal 28 by a second plug conductor 54. A fixed pin 42 is mounted in body 20 and extends out of body 20.

Embodiment with Removable Light Generating Device—Operation

The operation of the embodiment with removable light generating device is also very simple. The device is initially provided to the user without light generating device 30 installed. Just prior to use the user plugs light generating device 30 into socket 40 through opening 37. This completes the electrical circuit and light generating device 30 lights. The user then inserts the device into any surface at the desired location.

Chemical Embodiment—Description

Figure 13:
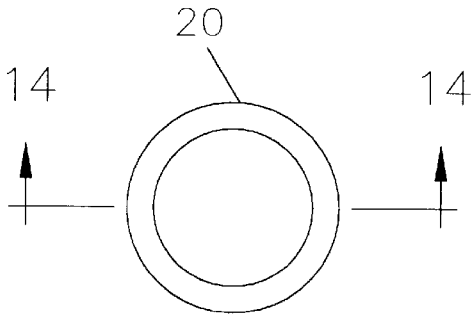
FIG. 13 is a top view of the chemical embodiment.
Figure 14:
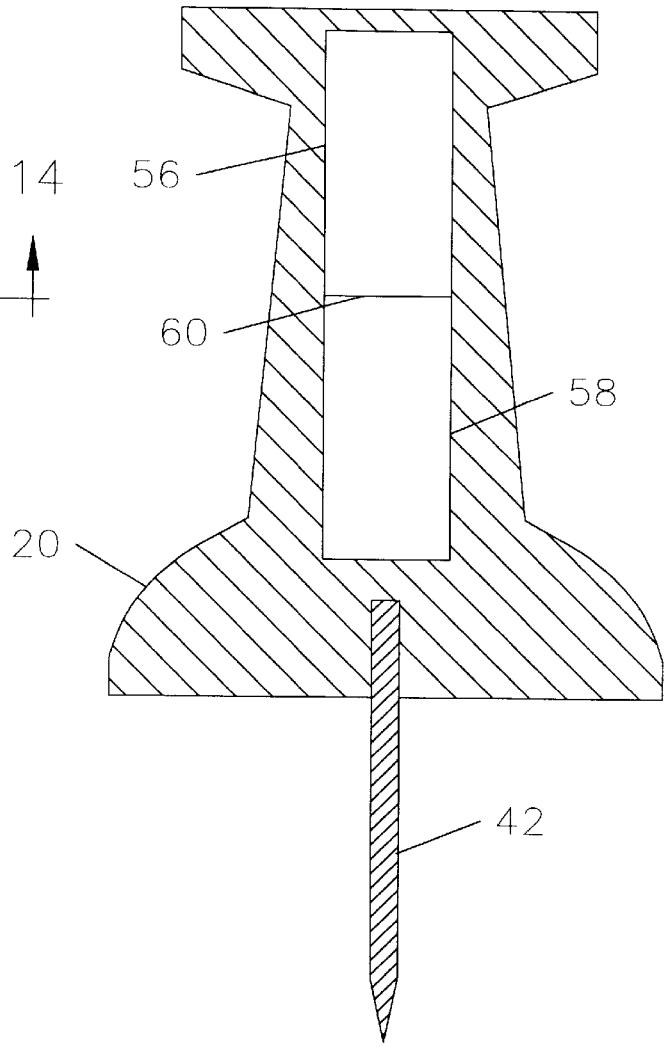
FIG. 14 is a front sectional view taken along the line 14—14 of FIG. 13.

FIG. 13 is a top view of the chemical embodiment and shows a body 20. The body 20 may be made of almost any material that will allow light to pass through it and the shape is not critical. As can be seen in FIG. 14, body 20 defines a first chemical reservoir 56 and a second chemical reservoir 58. A breakable barrier 60 separates the first chemical reservoir 56 and the second chemical reservoir 58. The first chemical reservoir 56 is filled with a first chemical and second chemical reservoir 58 is filled with a second chemical. A fixed pin 42 is mounted in body 20 and extends out of body 20.

Chemical Embodiment—Operation

The operation of the chemical embodiment is also very simple. The first and second chemicals are such that when mixed they generate light. The user simply inserts the invention into any surface at the desired location and squeezes the body 20. When body 20 is squeezed the breakable barrier 60 breaks allowing the two chemicals to mix thus generating light. It should be noted that any number of different methods might be used to break breakable barrier 60.

CONCLUSIONS, RAMIFICATIONS, AND SCOPE

Accordingly, it can be seen that the invention provides a relatively low cost, very simple to use lighted push pin that is suitable for use anywhere a push pin can be used. It can also be seen that the invention will provide a superior capability to draw attention to specific items or highlight specific information through the use of illumination.

Although the description above contains many specificities, these should not be construed as limiting the scope of the invention but as merely providing illustrations of some of the presently preferred embodiments of this invention. Various other embodiments and ramifications are possible within it's scope. For example: a means of replacing the battery may be included; a wide variety of different switches may be utilized; a wide variety of light generating devices may be used to provide light in different colors; the light generating device may be on continuously or blink in different patterns; or various means of breaking breakable barrier 60 in the chemical embodiment may be used. In addition, a wide range of shapes and materials may be used for body 20 and the other parts.

Thus the scope of the invention should be determined by the appended claims and their legal equivalents, rather than by the examples given.

What is claimed is:

1. A lighted push pin, comprising:

a body defining a cavity and a passage;

a light generating device having a first light generating device terminal and a second light generating device terminal;

a battery having a first battery terminal and a second battery terminal;

an electrical conductor;

a pin having a pin sharp end and a pin blunt end, said pin blunt end being of a size and shape such that said pin blunt end will not pass through said passage;

said light generating device being affixed to said body such that said first light generating device terminal and said second light generating device terminal are located in said cavity;

said electrical conductor electrically connecting said first light generating device terminal to said first battery terminal;

said battery located inside said cavity and resting on said pin blunt end such that said second battery terminal is aligned with said second light generating device terminal; and said pin slidably positioned in said passage with said pin blunt end located in said cavity and said pin sharp end located outside said body.

2. A lighted push pin as in claim 1, further comprising:

a pin stop affixed to said pin outside of said body.

3. A lighted push pin, comprising:

a body defining a cavity and a passage and an opening;

a light generating device;

a socket having a first socket terminal and a second socket terminal;

a battery having a first battery terminal and a second battery terminal;

an electrical conductor;

a pin having a pin sharp end and a pin blunt end, said pin blunt end being of a size and shape such that said pin blunt end will not pass through said passage;

said socket being affixed to said body such that said first socket terminal and said second socket terminal are located in said cavity;

said light generating device located in said opening and removably electrically plugged into said socket;

said electrical conductor electrically connecting said first socket terminal to said first battery terminal;

said battery located inside said cavity and resting on said pin blunt end such that said second battery terminal is aligned with said second socket terminal; and said pin slidably positioned in said passage with said pin blunt end located in said cavity and said pin sharp end located outside said body.

4. A lighted push pin as in claim 3, further comprising:

a pin stop affixed to said pin outside of said body.

5. A lighted push pin, comprising:

a body defining a cavity;

a light generating device having a first light generating device terminal and a second light generating device terminal;

a battery having a first battery terminal and a second battery terminal;

a switch;

a first switch conductor and a second switch conductor and a third switch conductor and a fourth switch conductor;

a fixed pin;

said light generating device being affixed to said body;

said switch attached to said body;

said battery located inside said cavity;

said switch electrically connected to said first battery terminal by said first switch conductor;

said switch electrically connected to said second battery terminal by said second switch conductor;

said switch electrically connected to said first light generating device terminal by said third switch conductor;

said switch electrically connected to said second light generating device terminal by said fourth switch conductor;

said fixed pin affixed to said body.

6. A lighted push pin, comprising:

a body defining a cavity and an opening;

a light generating device having a first light generating device terminal and a second light generating device terminal;

a battery having a first battery terminal and a second battery terminal;

a switch;

a socket having a first socket terminal and a second socket terminal;

a first switch conductor and a second switch conductor and a third switch conductor and a fourth switch conductor;

a fixed pin;

said socket being affixed to said body such that said socket is aligned with said opening;

said light generating device located in said opening and removably electrically plugged into said socket;

said switch attached to said body;

said battery located inside said cavity;

said switch electrically connected to said first battery terminal by said first switch conductor;

said switch electrically connected to said second battery terminal by said second switch conductor;

said switch electrically connected to said first socket terminal by said third switch conductor;

said switch electrically connected to said second socket terminal by said fourth switch conductor;

said fixed pin affixed to said body.

7. A lighted push pin, comprising:

a body defining a cavity and an opening;

a light generating device having a first light generating device terminal and a second light generating device terminal;

a battery having a first battery terminal and a second battery terminal;

a socket having a first socket terminal and a second socket terminal;

a first plug conductor and a second plug conductor;

a fixed pin;

said socket being affixed to said body such that said socket is aligned with said opening;

said light generating device located in said opening and removably electrically plugged into said socket;

said battery located inside said cavity;

said first socket terminal electrically connected to said first battery terminal by said first plug conductor;

said second socket terminal electrically connected to said second battery terminal by said second plug conductor;

said fixed pin affixed to said body.

8. A lighted push pin, comprising:

a body defining a first chemical reservoir and a second chemical reservoir;

a breakable barrier separating said first chemical reservoir and said second chemical reservoir;

a first chemical and a second chemical;

a fixed pin;

said first chemical reservoir filled with said first chemical;

said second chemical reservoir filled with said second chemical; and said fixed pin affixed to said body.

* * * * *